US007690521B1

(12) United States Patent
Herrera

(10) Patent No.: US 7,690,521 B1
(45) Date of Patent: Apr. 6, 2010

(54) BEVERAGE BOTTLE NIPPLE ADAPTER AND FUNNEL APPARATUS

(76) Inventor: John W. Herrera, 2908 El Camino Ave., Sacramento, CA (US) 95821

( * ) Notice: Subject to any disclaimer, the term of this patent is extended or adjusted under 35 U.S.C. 154(b) by 728 days.

(21) Appl. No.: 11/297,046

(22) Filed: Dec. 9, 2005

(51) Int. Cl.
*A61J 11/04* (2006.01)
*B65D 47/00* (2006.01)

(52) U.S. Cl. ..... 215/11.1; 215/228; 215/386; 141/340

(58) Field of Classification Search ..... 215/11.1, 215/11.6, 228, 276, 386, 229, DIG. 7; 141/340–343, 141/331; 220/212, 86.1, 694
See application file for complete search history.

(56) References Cited

U.S. PATENT DOCUMENTS

| | | | | | |
|---|---|---|---|---|---|
| 129,024 | A * | 7/1872 | George | 141/343 |
| 285,597 | A * | 9/1883 | Eustis | 141/343 |
| 518,530 | A * | 4/1894 | McAlpin | 220/212 |
| 589,659 | A * | 9/1897 | Krack | 141/343 |
| 790,080 | A * | 5/1905 | Seavy | 141/343 |
| 4,149,575 | A * | 4/1979 | Fisher | 141/98 |
| 4,898,290 | A | 2/1990 | Cueto | |
| D313,848 | S | 1/1991 | Corso | |
| 5,021,206 | A * | 6/1991 | Stoops | 264/155 |
| 5,024,341 | A * | 6/1991 | Dekerle | 215/11.1 |
| 5,101,870 | A * | 4/1992 | Farris | 141/343 |
| 5,292,035 | A | 3/1994 | Millar | |
| 5,762,120 | A * | 6/1998 | Smith | 141/340 |
| 5,921,296 | A * | 7/1999 | Porter et al. | 141/340 |
| 5,950,689 | A | 9/1999 | Varlet | |
| 6,209,737 | B1 * | 4/2001 | Bliss | 215/228 |
| 6,223,792 | B1 * | 5/2001 | Slagle | 141/331 |
| 6,354,449 | B1 * | 3/2002 | Smith | 215/11.1 |
| 6,397,907 | B1 * | 6/2002 | Heintz | 141/338 |
| 6,425,424 | B1 * | 7/2002 | Ellis Calvo et al. | 141/331 |
| 6,851,565 | B2 * | 2/2005 | Stephan | 215/389 |
| 2002/0162816 | A1 * | 11/2002 | Walsh | 215/11.1 |
| 2003/0029829 | A1 | 2/2003 | Stephan | |
| 2003/0205548 | A1 | 11/2003 | Seckler | |
| 2006/0113270 | A1 * | 6/2006 | Rea | 215/11.6 |
| 2006/0151420 | A1 * | 7/2006 | Espenschied | 215/276 |
| 2007/0079898 | A1 * | 4/2007 | Grover et al. | 141/340 |

FOREIGN PATENT DOCUMENTS

| | | | |
|---|---|---|---|
| FR | 2603187 | A1 * | 3/1988 |
| JP | 8276913 | * | 10/1996 |

* cited by examiner

*Primary Examiner*—Sue A Weaver

(57) ABSTRACT

A beverage bottle nipple adapter and funnel apparatus includes a perimeter wall that has a first edge and a second edge positioned opposite of each other. A peripheral lip is attached to and is coextensive with the first edge. The peripheral lip extends away from the perimeter wall. The peripheral lip has an exterior surface and an interior surface each being threaded. The interior surface has a size configured for receiving and threadably coupling to the threaded neck. The perimeter wall may be positioned in funnel position extending upwardly from the threaded neck or in a nipple receiving position extending downwardly from the threaded neck. A nipple is positioned in a threaded nipple coupler and the threaded nipple coupler is threadably coupled to the exterior surface of the peripheral lip when the perimeter wall is in the nipple receiving position.

3 Claims, 3 Drawing Sheets

BEVERAGE BOTTLE NIPPLE ADAPTER AND FUNNEL APPARATUS

BACKGROUND OF THE INVENTION

1. Field of the Invention

The present invention relates to nipple adapter devices and more particularly pertains to a new nipple adapter device for allowing a person to use a conventional beverage bottle for a baby bottle and which further assists the person in filling the beverage bottle with baby formula powder and fluids.

2. Description of the Prior Art

The use of nipple adapter devices is known in the prior art. While these devices fulfill their respective, particular objectives and requirements, the need remains for a device that not only allows attachment of a nipple to a beverage bottle, but which also may be used as a funnel for pouring powders and fluids into the beverage bottle which has a relatively small diameter.

SUMMARY OF THE INVENTION

The present invention meets the needs presented above by generally comprising a perimeter wall that has a first edge and a second edge positioned opposite of each other. A peripheral lip is attached to and is coextensive with the first edge. The peripheral lip extends away from the perimeter wall. The peripheral lip has an exterior surface and an interior surface each being threaded. The interior surface has a size configured for receiving and threadably coupling to the threaded neck. The perimeter wall may be positioned in funnel position extending upwardly from the threaded neck or in a nipple receiving position extending downwardly from the threaded neck. A nipple is positioned in a threaded nipple coupler and the threaded nipple coupler is threadably coupled to the exterior surface of the peripheral lip when the perimeter wall is in the nipple receiving position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
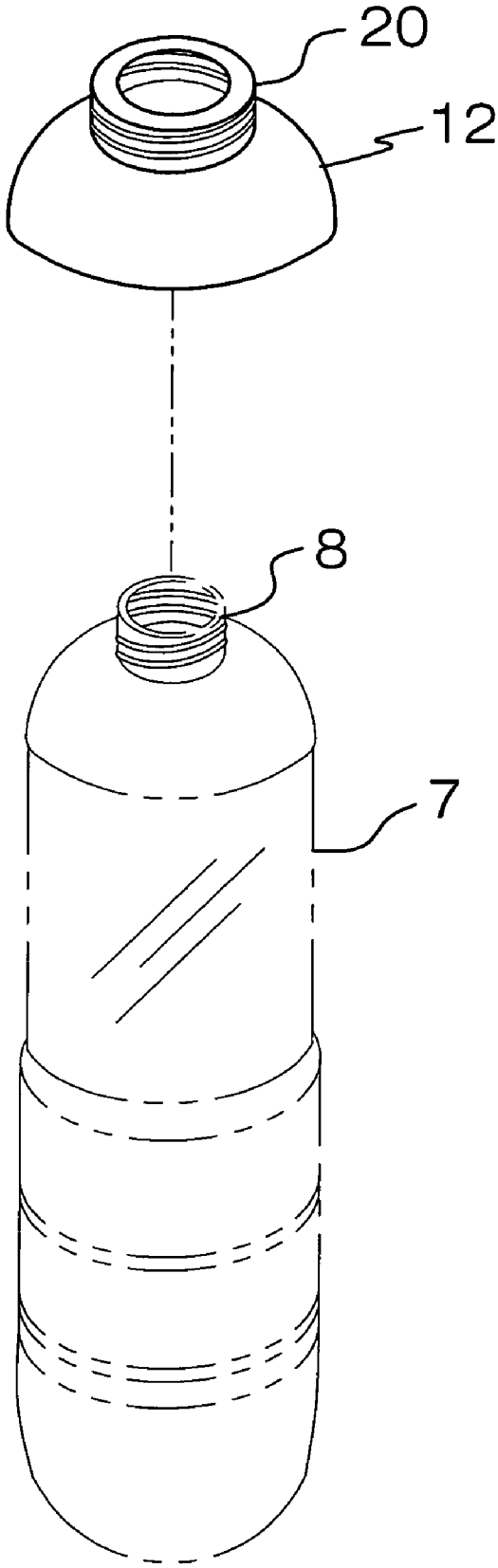
FIG. 1 is a perspective view of a beverage bottle nipple adapter and funnel apparatus according to the present invention.

With reference now to the drawings, and in particular to FIGS. 1 through 5 thereof, a new nipple adapter device embodying the principles and concepts of the present invention and generally designated by the reference numeral 10 will be described.

As best illustrated in FIGS. 1 through 5, the beverage bottle nipple adapter and funnel apparatus 10 generally comprises a perimeter wall 12 that has a first edge 14 and a second edge 16 positioned opposite of each other. Each of the first 14 and second 16 edges has a circular shape. The first edge 14 defines a first opening 15 and the second edge 16 defines a second opening 17. The first opening 15 has a smaller diameter than the second opening 17. The peripheral wall 12 has an inner surface that has a concave shape from the first edge 14 to the second edge 16.

Figure 2:
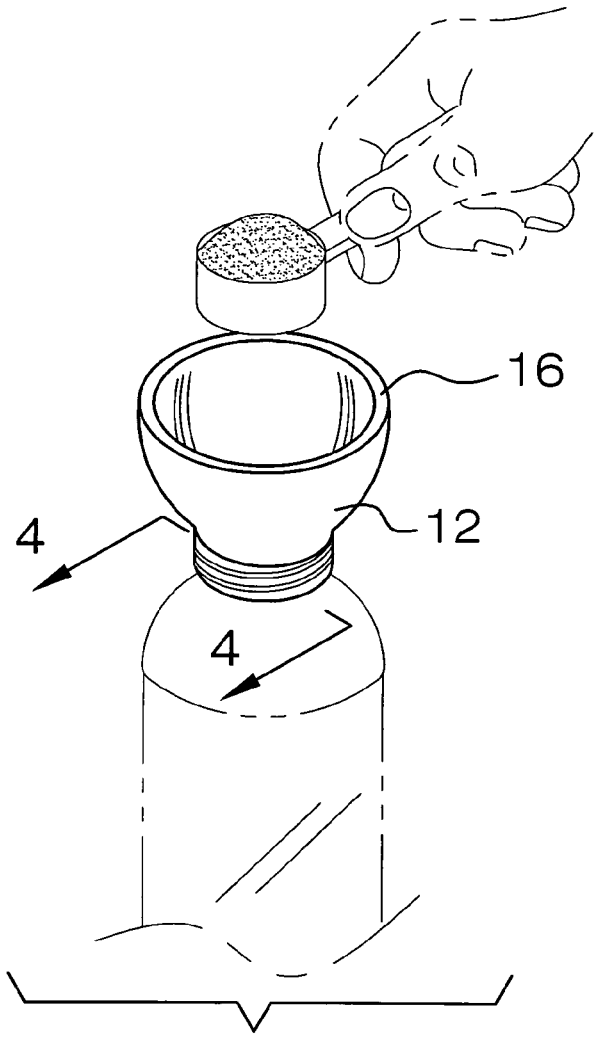
FIG. 2 is a perspective view of the present invention.
Figure 3:
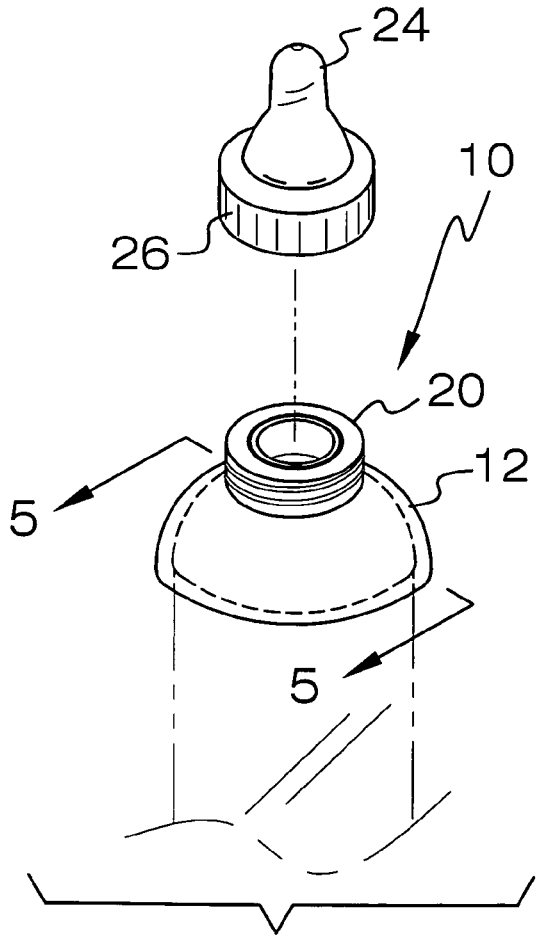
FIG. 3 is a perspective view of the present invention.
Figure 4:
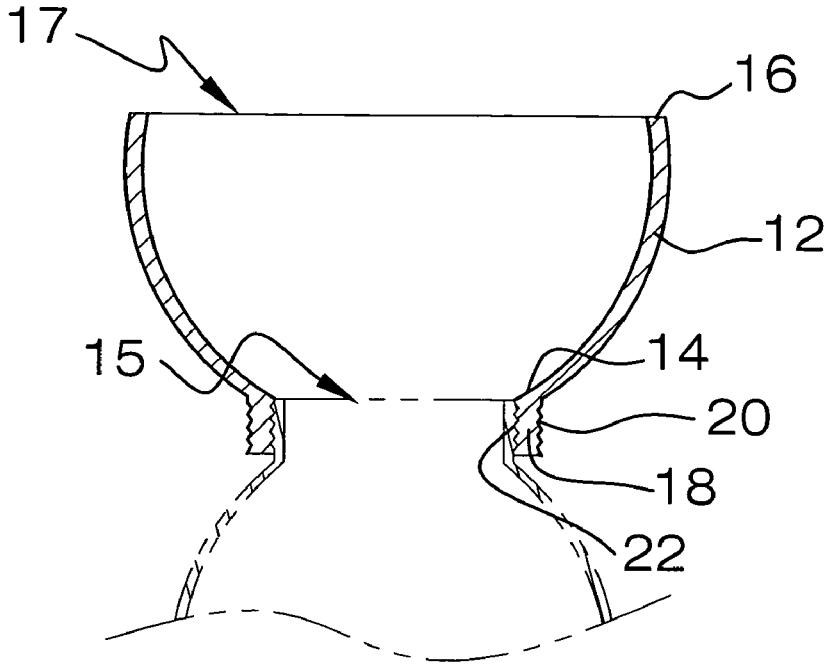
FIG. 4 is a cross-sectional view taken along line 4-4 of FIG. 2 the present invention.

A peripheral lip 18 is attached to and is coextensive with the first edge 14. The peripheral lip 18 has a cylindrical shape and extends away from the perimeter wall 12. The peripheral lip 18 has an exterior surface 20 and an interior surface 22. Each of the exterior 20 and interior 22 surfaces is threaded. The interior surface 22 has a size configured for receiving and threadably coupling to a threaded neck 8 of a beverage bottle 7, such as a conventional water bottle. The perimeter wall 12 may be positioned in funnel position, as shown in FIG. 2, extending upwardly from the threaded neck 8 or in a nipple receiving position, as shown in FIG. 3, extending downwardly from the threaded neck 8.

A nipple 24 is positioned in a threaded nipple coupler 26. The threaded nipple coupler 26 is threadably coupled to the exterior surface 20 of the peripheral lip 18 when the perimeter wall 12 is in the nipple receiving position. The nipple coupler 26 and nipple 24 are preferably of conventional size and shape.

Figure 5:
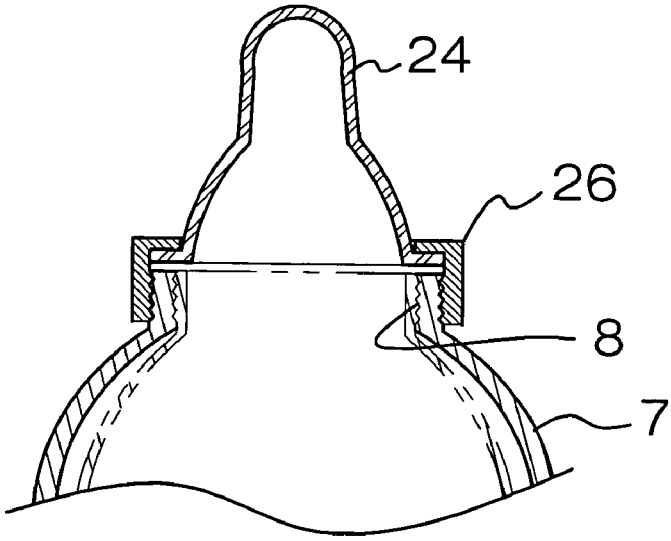
FIG. 5 is a cross-sectional view taken along line 5-5 of FIG. 3 of the present invention.

In use, the peripheral lip 20 is first attached to a threaded neck 8 of a beverage bottle 7, such as a water bottle, so that the perimeter wall 12 functions as a funnel. As shown in FIG. 2, this allows formula or other food items and liquids to be easily poured into the bottle. Once the bottle 7 is filled, the perimeter wall 12 is flipped over so that it may receive the threaded nipple coupler 26 and nipple 24 as shown in FIG. 5. The beverage bottle 7 is then used as a conventional baby feeding bottle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nipple adapter and funnel assembly for positioning on a beverage bottle having a threaded neck, said assembly comprising:

a perimeter wall having a first edge and a second edge positioned opposite of each other, each of said first and second edges having a circular shape, said first edge defining a first opening and said second edge defining a second opening, said first opening having a smaller diameter than said second opening, said perimeter wall having an inner surface having a concave shape from said first edge to said second edge;

a peripheral lip being attached to and being coextensive with said first edge, said peripheral lip extending away from said perimeter wall, said peripheral lip having an exterior surface and an interior surface, each of said exterior and interior surfaces being threaded, said interior surface having a size configured for receiving and threadably coupling to the threaded neck, wherein said perimeter wall may be positioned in a funnel position extending upwardly from the threaded neck or in a nipple receiving position extending downwardly from the threaded neck; and a nipple extending through a threaded nipple coupler, said threaded nipple coupler being threadably coupled to said exterior surface of said peripheral lip when said perimeter wall is in said nipple receiving position.

2. A nipple adapter and funnel assembly for positioning on a beverage bottle having a threaded neck, said assembly comprising:

a perimeter wall having a first edge and a second edge positioned opposite of each other;

a peripheral lip being attached to and being coextensive with said first edge, said peripheral lip extending away from said perimeter wall, said peripheral lip having an exterior surface and an interior surface, each of said exterior and interior surfaces being threaded, said interior surface having a size configured for receiving and threadably coupling to the threaded neck, said perimeter wall being positionable in a funnel position having said interior surface being threadably coupled to the threaded neck and said perimeter wall extending upwardly from the threaded neck or in a nipple receiving position having said interior surface being threadably coupled to the threaded neck and said perimeter wall extending downwardly from the threaded neck; and a nipple extending through a threaded nipple coupler, said threaded nipple coupler being threadably coupled to said exterior surface of said peripheral lip when said perimeter wall is in said nipple receiving position.

3. The assembly according to claim 2, wherein each of said first and second edges has a circular shape, said first edge defining a first opening and said second edge defining a second opening, said first opening having a smaller diameter than said second opening.

* * * * *